US005520751A

United States Patent [19]

Pareek et al.

[11] Patent Number: 5,520,751

[45] Date of Patent: May 28, 1996

[54] OXIDATION OF LOW CHROMIUM STEELS

[75] Inventors: Vinod K. Pareek, Flemington; Trikur A. Ramanarayanan, Somerset; James D. Mumford, Long Valley, all of N.J.; Adnan Ozekcin, Bethlehem, Pa.

[73] Assignee: Exxon Research and Engineering Company, Florham Park, N.J.

[21] Appl. No.: 294,697

[22] Filed: Aug. 23, 1994

Related U.S. Application Data

[63] Continuation-in-part of Ser. No. 126,616, Sep. 24, 1993, abandoned.

[51] Int. Cl.[6] ..... C23C 8/10

[52] U.S. Cl. ..... 148/286; 148/287; 420/34; 420/104; 428/472.1; 428/472.2

[58] Field of Search ..... 148/286, 287; 428/472.1, 472.2; 420/34, 104

[56] References Cited

U.S. PATENT DOCUMENTS

| | | | |
|---|---|---|---|
| 3,704,333 | 11/1972 | Spangler et al. | 585/636 |
| 4,168,184 | 9/1979 | Hultquist et al. | 148/286 |
| 4,297,150 | 10/1981 | Foster et al. | 148/276 |

FOREIGN PATENT DOCUMENTS

| | | | |
|---|---|---|---|
| 2009085 | 10/1970 | Germany . | |
| 64-11957 | 1/1989 | Japan | 148/286 |

OTHER PUBLICATIONS

"The Effect of Preoxidation of Some Ni, Fe and Co–Base Alloys on Subsequent Sulfidation at 982° C. in Sulfur Vapor," Oxidation of Metals, vol. 30, Nos. 5/6, 1988, Sheybany & Douglass, pp. 433–463.

*Primary Examiner*—David A. Simmons
*Assistant Examiner*—Robert R. Koehler
*Attorney, Agent, or Firm*—Estelle C. Bakun

[57] ABSTRACT

The present invention is a process for forming protective films on an alloy substrate by: oxidizing an alloy comprising iron and chromium in an oxygen containing atmosphere, said alloy containing from about 5 to about 15 wt % chromium, at a temperature of from about 200° C. (473° K.) to about 1400° C. (1673° K.), more preferably 300° C. (573° K.) to 600° C. (873° K.) wherein the partial pressure of oxygen in said oxygen containing atmosphere is above or equal to the dissociation pressure of $Fe_3O_4$ and FeO below or equal to the dissociation pressure of $Fe_2O_3$ within the specified temperature range, and for a time sufficient to effect the formation of a film comprising iron-chromium oxide ($FeCr_2O_4$) spinel on the surface of said alloy. In a further embodiment, the film may additionally contain Silicon.

4 Claims, 3 Drawing Sheets

OXIDATION OF LOW CHROMIUM STEELS

This is a continuation-in-part of U.S. Ser. No. 126,616, filed Sep. 24, 1993 now abandoned.

FIELD OF THE INVENTION

Chromium steel alloys, containing >15 wt % chromium, are known to undergo oxidation thereby forming a protective surface film of chromium oxide which is resistant to corrosion such as sulfidation. Such steels are rather expensive because of the high cost of chromium. Steels for refinery construction applications are less expensive, having a relatively low chromium content of about 5–15 wt %. This low chromium content is unable to effect the formation of a corrosion protective chromium oxide film upon the surface of refinery steels. Hence, such steels are attacked by organic sulfur compounds present in crudes, which react with iron in the steel, leading to the formation of an iron sulfide corrosion product which consumes iron rapidly by providing an easy diffusion path for the migration of ferrous ions. What is needed in the art is a method of treating refinery steels which will control the formation of the iron sulfide corrosion product, thus providing significantly enhanced sulfidation resistance.

SUMMARY OF THE INVENTION

Applicants have found that protective surface films which are resistant to corrosive sulfidation can be formed on the surface of low chromium refinery steels comprised of iron-chromium alloys having a chromium content of about 5 to 15 wt %. These films which are spinels (mixed iron chromium oxide solid solutions) are formed by a controlled oxidation treatment at temperatures ranging from 200° to 1400° C. at oxygen partial pressures slightly higher than those needed to nucleate FeO and $Fe_3O_4$ on the surface of the refinery steel. Both iron oxide and chromium oxide nucleate on the alloy surface under these conditions, followed by lateral growth and reaction to establish this spinel layer. The spinels formed are corrosion barriers resistant to attack by organic sulfur compounds.

Accordingly, the present invention is a process for forming protective films on an alloy substrate comprising: oxidizing an alloy comprising iron and chromium in an oxygen containing atmosphere, said alloy containing from about 5 to about 15 wt % chromium, at a temperature of from about 200° C. (473° K.) to about 1400° C. (1673° K.), more preferably 300° C. (573° K.) to 600° C. (873° K.), wherein the partial pressure of oxygen in said oxygen containing atmosphere is above or equal to the dissociation pressure of $Fe_3O_4$ from 200° C. to 560° C. and equal to or above the dissociation pressure of FeO from 560° C. to 1400° C. and below or equal to the dissociation pressure of $Fe_{23}$ from 200° to 1400° C., and for a time sufficient to effect the formation of a film comprising iron-chromium oxide ($FeCr_2O_4$) spinels on the surface of said alloy. Spinels are defined as oxides consisting of two or more metals and are hence mixed metal oxides.

The present invention is further directed to a corrosion resistant alloy substrate comprising an iron-chromium alloy containing at least about 5 to about 15 wt % chromium, said substrate having grown thereon a film comprising a mixed spinel of iron-chromium-oxide.

The alloys of the present invention may further comprise other alloying constituents such as silicon in amounts ranging from about 1 to about 2 wt %.

BRIEF DESCRIPTION OF THE DRAWINGS

FIG. 2 demonstrates that a 20 fold improvement can be obtained when utilizing an iron-chromium alloy that additionally contains silicon at concentration levels ranging from 1–2%.

Figure 1:
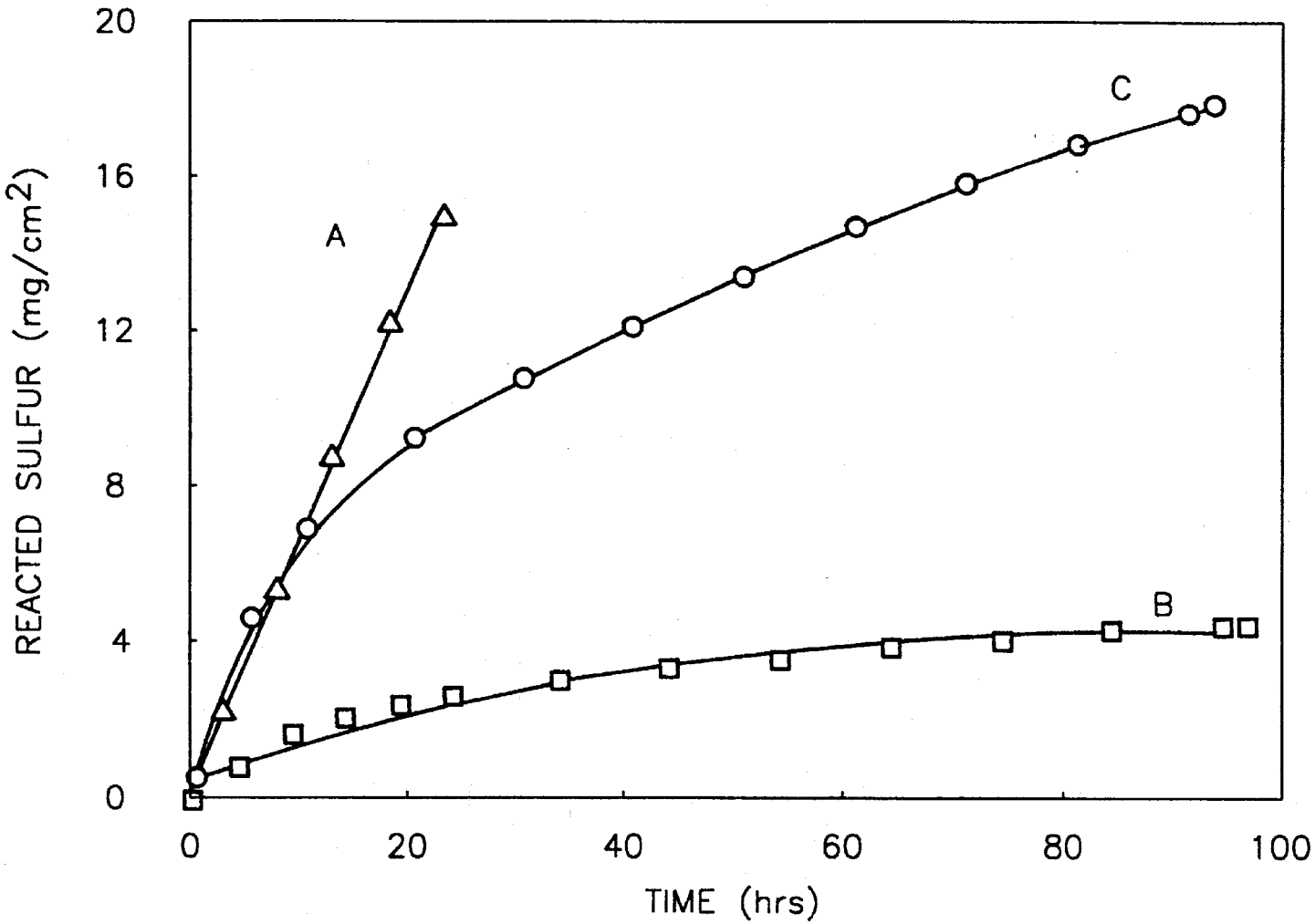
FIG. 1 shows the rate of sulfidation at 538° C. (811° K.) in an atmosphere of 0.5% $CH_3SH$ in argon, of an iron chromium alloy containing 7 wt % chromium after pro-oxidation at 538° C. (811° K.) for 65 hours in a $CO/CO_2$ gas mixture. The figure demonstrates the importance of maintaining the oxygen partial pressure during the oxidation process at or above the dissociation pressure of $Fe_3O_4$ and FeO and below the dissociation pressure of $Fe_2O_3$ within the temperature range of 200°–1400° C. Line A, depicted by triangles, illustrates the extent of sulfidation corrosion when the partial pressure of $O_2$ during oxidation is below the dissociation pressure of $Fe_3O_4$ and FeO, line B, depicted by squares, illustrates the result when the partial pressure of $O_2$ is above the dissociation pressure of $Fe_2O_3$ during oxidation, and line C, depicted by circles, illustrates the sulfidation rate when the iron chromium alloy is not oxidized.
Figure 2:
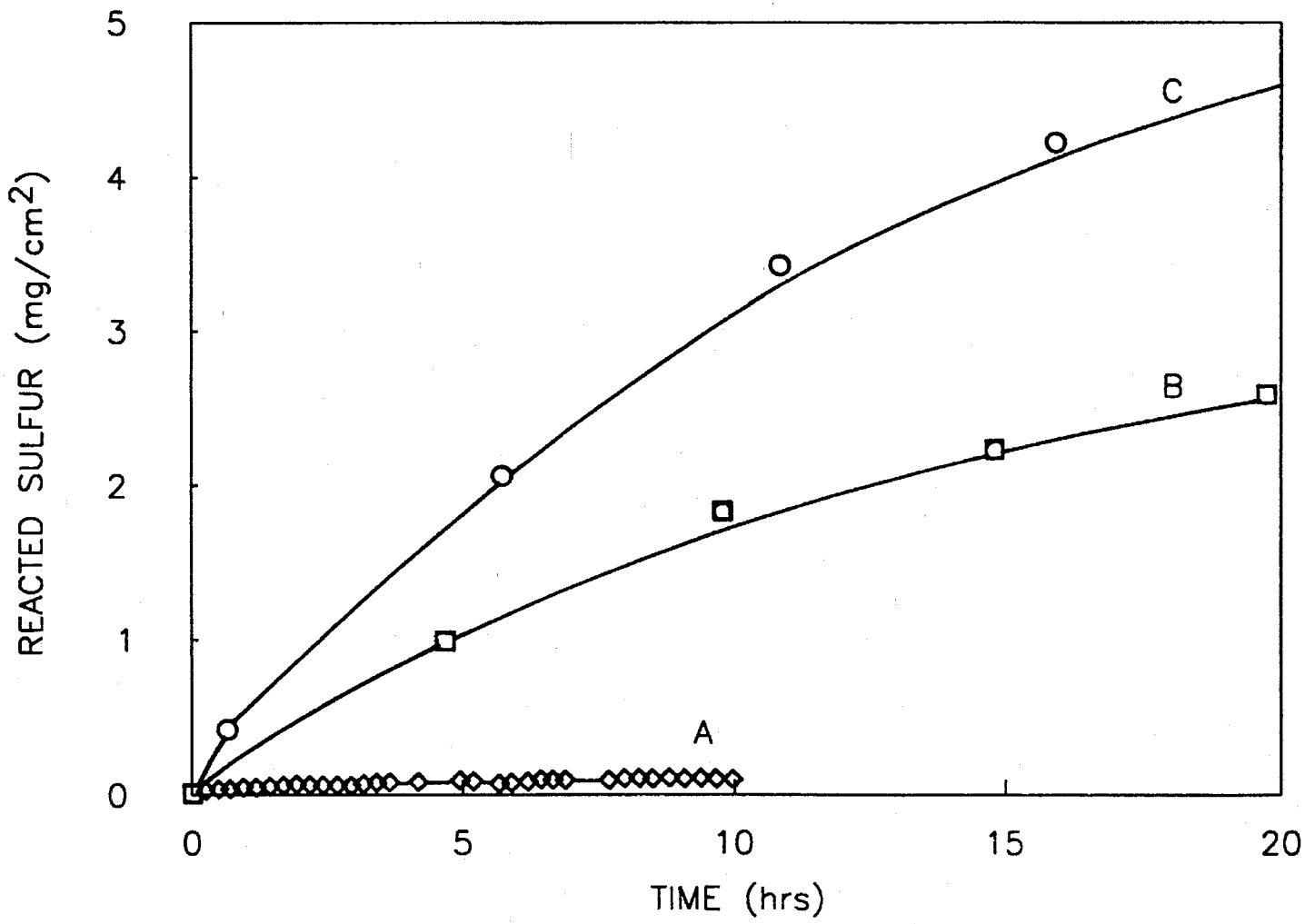
FIG. 2 shows the sulfidation rate for a oxidized iron-chromium alloy prepared in accordance with the instant invention depicted by the line with squares, the same alloy without oxidation is depicted by circles, and the same alloy additionally containing 1.6 wt % silicon and having undergone oxidation in accordance with the instant invention is depicted by diamonds.

In both FIGS. 1 and 2 the Y axis is reacted sulfur ($mg/cm^2$) and the X axis is time in hours.

Figure 3:
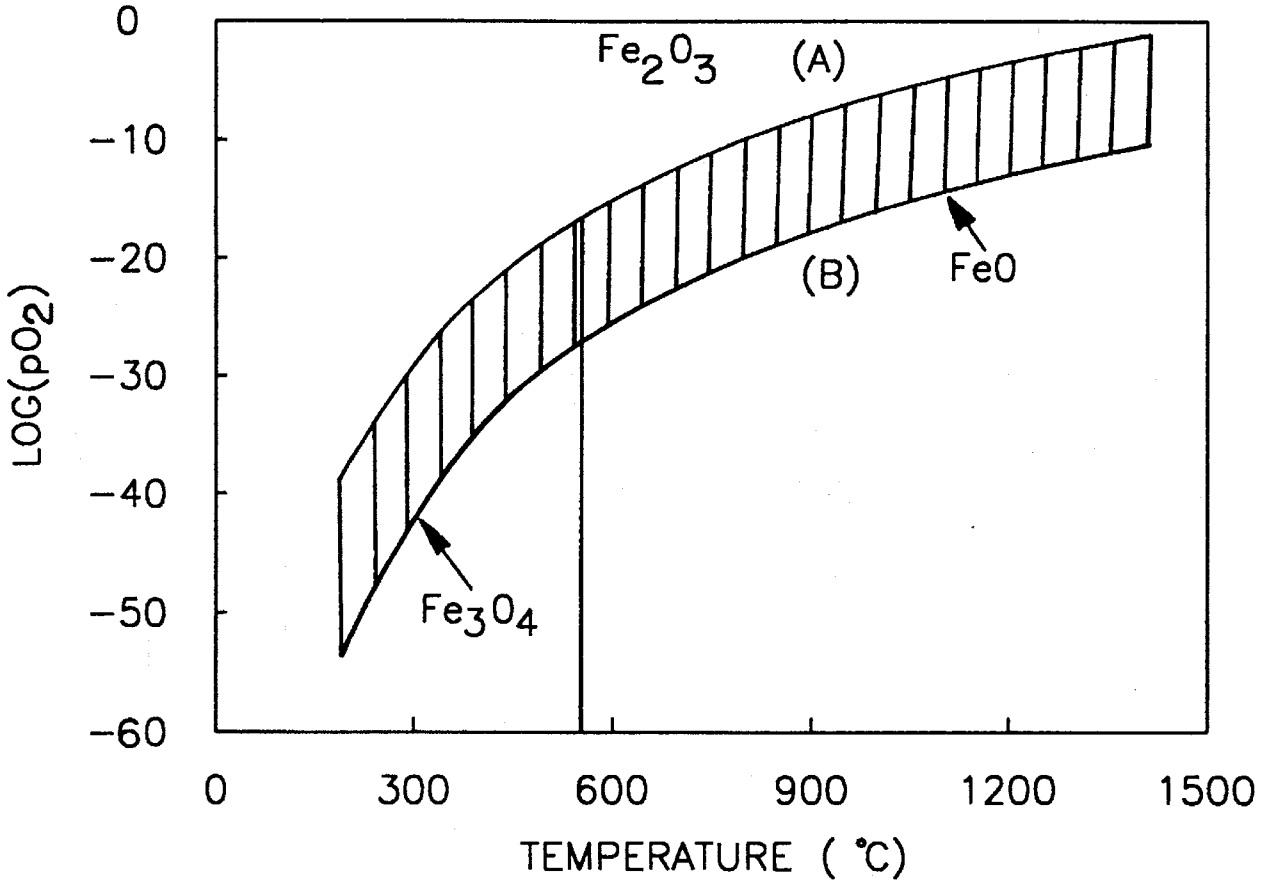

FIG. 3 shows the oxygen partial pressures which must be used over the specified temperature range to obtain mixed iron-chromium spinels on the surface of a given substrate. The partial pressures utilizable are above or along line B and below or along line A within the temperature range of 200°–1400° C. Hence, any partial pressure between or along lines A and B and within the specified temperature range can be used (as shown by the hatched area).

DETAILED DESCRIPTION

The process of the present invention is suitable for protecting surfaces of alloys comprising iron and chromium. The amount of chromium in such alloys can vary from about 5 to about 15 wt %. In a preferred embodiment, the alloys will further comprise silicon in an amount ranging from about 1 to about 2 wt %, preferably about 1.5 wt %. Suitable alloys are, for example, iron containing 5 wt % chromium (Fe-5%Cr), Fe-7%Cr, Fe-5Cr-x%Si (x=about 1 to about 2 wt %), etc. and are commercially available. The commercial alloys would typically contain small concentrations of C (0.15 max), Mn(0.3–0.6), P(0.025 max), S(0.025 max), and Mo(0.45 to 0.65%). These elements at the concentrations indicated, however, do not affect the oxidation process to any significant extent.

To obtain the protective films of the present invention, it is necessary to conduct the oxidation under controlled conditions. The temperature will range from about 200° C. (473° K.) to about 1400° C. (1673° K.), preferably about 300 (573° K.) to about 600° C. (873° K.), and most preferably about 550° C. (823° K.). The partial pressure of oxygen in the oxidizing medium must be maintained at a value depicted by the hatched area of FIG. 3. Such a partial pressure is necessary to prevent the formation of internally oxidized chromium oxide particles (which provide no corrosion protection) as opposed to surface spinel films. The partial pressure of $O_2$ may be selected from the shaded area depicted on FIG. 3. As used herein, pure iron oxides are oxides of iron alone and not iron oxides in conjunction with any other elemental oxides. The present invention requires the formation of spinels of iron chromium oxide; it avoids the formation of iron oxide alone which hardly provides any corrosion protection in sulfur-containing environments. The protective films of the present invention, which are a mixed iron chromium spinel, impede the migration, through the film, of ferrous ions which would form a corrosion product.. Any oxidizing medium can be utilized to accomplish the oxidation of the present invention. For example techniques known to those skilled in the art such as heating in an atmosphere of $CO:CO_2$ mixtures, steam:$H_2$ mixtures, ammonia:steam mixtures, steam, air, or any other oxidizing medium can be utilized as long as the temperature and oxygen partial pressure criteria are observed.

The time necessary to carry out the oxidation is not critical and depends on the depth of the film desired and the oxidation temperature. Such criteria are readily determinable by one skilled in the art. For example, at 538° C. (811° K.), an oxidation time of about 65 hours, provides a spinel film thickness of 7 μm. Longer reaction times will be necessary for lower temperatures of reaction. The overall economics will be dictated by a balance between the oxidation temperature and the oxidation time in order to achieve a desired film thickness.

The present invention can be utilized to effect the formation of films ranging from about 5 microns to about 50 microns. The desired depth can be easily adjusted by adjusting the time and/or temperature of the reaction within the range specified. Such films can be formed in-situ once the alloys are in place, as for example in refinery vessels and piping, or can be formed prior to installation of such alloys.

As a result of the oxidation method of this invention, an iron chromium alloy substrate having a protective surface film ranging from about 5 to 50 microns and resistant to corrosive sulfidation is obtained. When an alloy containing at least about 1 wt % silicon in addition to iron and chromium is oxidized, some of the silicon is incorporated into the spinel film. The modified spinel composition may be represented as $(Fe,Si)Cr_2O_4$. The presence of silicon in the film is found to further suppress corrosion by hindering the transport of ferrous ions.

The invention is further illustrated with reference to the following examples.

EXAMPLE 1

A commercially available iron chromium alloy containing 7 wt % chromium was oxidized by treatment with a $CO:CO_2$ gas stream and at an $O_2$ partial pressure of $\sim 10^{-24}$ atm ($1{,}013\times10^{-22}$ kPa). The temperature of reaction was 538° C. (811° K.) and the time of reaction was 65 hrs. A second sample of the above alloy was treated as above except that the $O_2$ partial pressure was $10^{-28}$ ($1.013\times10^{-26}$ kPa) atm. which is below the dissociation pressure of $Fe_3O_4$ and FeO. These two oxidized alloys were then compared to the untreated alloy for corrosion resistance to sulfidation in an atmosphere of 0.5%$H_3SH$ in argon at 538° C. (811° K.). The results are graphically depicted in FIG. 1. Line A shows the effect when the partial pressure of $O_2$ is not maintained above the dissociation pressure of $Fe_3O_4$ and FeO. Such an oxidized alloy is less resistant to sulfidation than an untreated alloy. Line C represents the untreated alloy, and line B represents the treated alloy where the $O_2$ partial pressure is maintained above the dissociation pressure of $Fe_3O_4$ and FeO and below the dissociation pressure of $Fe_2O_3$ at 538° C. during oxidation in accordance with the present invention. The results demonstrate that a factor of 5 corrosion protection was achieved for the 100 hour test with the alloy treated in accordance with the instant invention.

EXAMPLE 2

An iron chromium alloy containing 1.6 wt % silicon and 7 wt % chromium was oxidized and then subjected to sulfidation according to the procedure described in example 1. The results are graphically depicted in FIG. 2. Also shown in FIG. 2 are the sulfidation corrosion curves for the oxidized Fe-7Cr alloy and the untreated Fe-7Cr alloy. The results show that iron chromium alloys additionally containing silicon lead to a factor of 20 improvement in corrosion resistance. The silicon containing oxidized alloy is represented by the line with diamonds (A), the oxidized alloy without the silicon is represented by the line with squares (B), and the untreated alloy without silicon is represented by the line with circles (C).

What is claimed is:

1. A process for forming protective films on an alloy substrate comprising:

oxidizing an alloy comprising iron and chromium in an oxidizing atmosphere, said alloy containing from about 5 to about 15 wt % chromium, at a temperature of from about 200° C. (473° K.) to about 1400° C. (1673° K.), wherein the partial pressure of oxygen in said oxidizing atmosphere is above or equal to the dissociation pressure of $Fe_3O_4$ from 200° C. to 560° C. and equal to or above the dissociation pressure of FeO from 560° C. to 1400° C. and below or equal to the dissociation pressure of $Fe_2O_3$ from 200° to 1400° C., and for a time sufficient to effect the formation of a film comprising iron-chromium oxide ($FeCr_2O_4$) spinels on the surface of said alloy wherein said oxidizing atmosphere is a $CO:CO_2$ atmosphere.

2. An alloy substrate comprising an iron-chromium alloy containing at least about 5 to about 15 wt % chromium, said substrate being oxidized in a $CO:CO_2$ atmosphere and having grown thereon a film comprising mixed spinels of iron-chromium-oxide.

3. The alloy substrate of claim 2 wherein said iron chromium alloy further comprises silicon.

4. The alloy substrate of claim 3 wherein said silicon is present in an amount of about 1 wt % to about 2 wt %.

* * * * *

UNITED STATES PATENT AND TRADEMARK OFFICE

CERTIFICATE OF CORRECTION

PATENT NO. : 5,520,751

DATED : May 28, 1996

INVENTOR(S) : Vinod K. Pareek, et.al.

It is certified that error appears in the above-identified patent and that said Letters Patent is hereby corrected as shown below:

Column 1, line 54, replace "$Fe_{23}$" with --$Fe_2O_3$--.

Column 2, line 3, replace "pro-" with --pre---.

Column 4, line 2, replace "$H_3SH$" with $CH_3SH$--.

Signed and Sealed this

Third Day of February, 1998

*Attest:*

Bruce Lehman

BRUCE LEHMAN

*Attesting Officer*

*Commissioner of Patents and Trademarks*